US010576352B2

(12) United States Patent
Vester

(10) Patent No.: US 10,576,352 B2
(45) Date of Patent: Mar. 3, 2020

(54) FITNESS-EQUIPMENT STORAGE BENCH

(71) Applicant: James Edward Vester, Ilkeston (GB)

(72) Inventor: James Edward Vester, Ilkeston (GB)

( * ) Notice: Subject to any disclaimer, the term of this patent is extended or adjusted under 35 U.S.C. 154(b) by 0 days.

(21) Appl. No.: 16/095,659

(22) PCT Filed: Apr. 20, 2017

(86) PCT No.: PCT/GB2017/051099
§ 371 (c)(1),
(2) Date: Oct. 22, 2018

(87) PCT Pub. No.: WO2017/182808
PCT Pub. Date: Oct. 26, 2017

(65) Prior Publication Data

US 2019/0126122 A1 May 2, 2019

Related U.S. Application Data

(60) Provisional application No. 62/325,370, filed on Apr. 20, 2016.

(51) Int. Cl.
*A63B 71/00* (2006.01)
*A63B 21/00* (2006.01)
(Continued)

(52) U.S. Cl.
CPC ..... *A63B 71/0036* (2013.01); *A63B 21/4029* (2015.10); *A63B 47/00* (2013.01);
(Continued)

(58) Field of Classification Search
CPC . A63B 71/0036; A63B 21/4029; A63B 47/00; A63B 2225/09; A63B 2210/50;
(Continued)

(56) References Cited

U.S. PATENT DOCUMENTS 2,904,383 A * 9/1959 Potts ..... A63B 55/00 312/237
3,483,574 A * 12/1969 Belnap ..... A61G 13/009 5/86.1

(Continued)

FOREIGN PATENT DOCUMENTS

DE 29516681 U1 * 12/1995 ..... A47B 81/00

OTHER PUBLICATIONS

International Search Report for PCT/GB2017/051099 dated Aug. 9, 2017.

(Continued)

*Primary Examiner* — Stanton L Krycinski
(74) *Attorney, Agent, or Firm* — Millman IP Inc.

(57) ABSTRACT

A fitness-equipment storage bench (10) for use in aiding or supplementing a physical activity in a physical-activity environment whilst enabling storage of fitness equipment, the fitness-equipment storage bench (10) comprising a cuboidal or substantially cuboidal body (12) having first and second ends (14, 16), two opposing sides (18,20) between the first and second ends (14, 16), a top (22) and a bottom (24); at least one recess (26) formed in one of the said sides (18, 20); at least one cantilevered bar support (52) in the recess (26) for supporting a dumbbell (50) such that a grip axis of the dumbbell (50) is received entirely within the recess (26); at least one rotatable element (130) at or adjacent to the first end (14) or the second end (16) to facilitate reorientation of the bench (10); a pivotable user back support (30) on the top of the cuboidal body (12); and a stay (32) associated with the back support (30) to hold the back support (30) in at least one raised condition.

17 Claims, 14 Drawing Sheets

Figure 1:
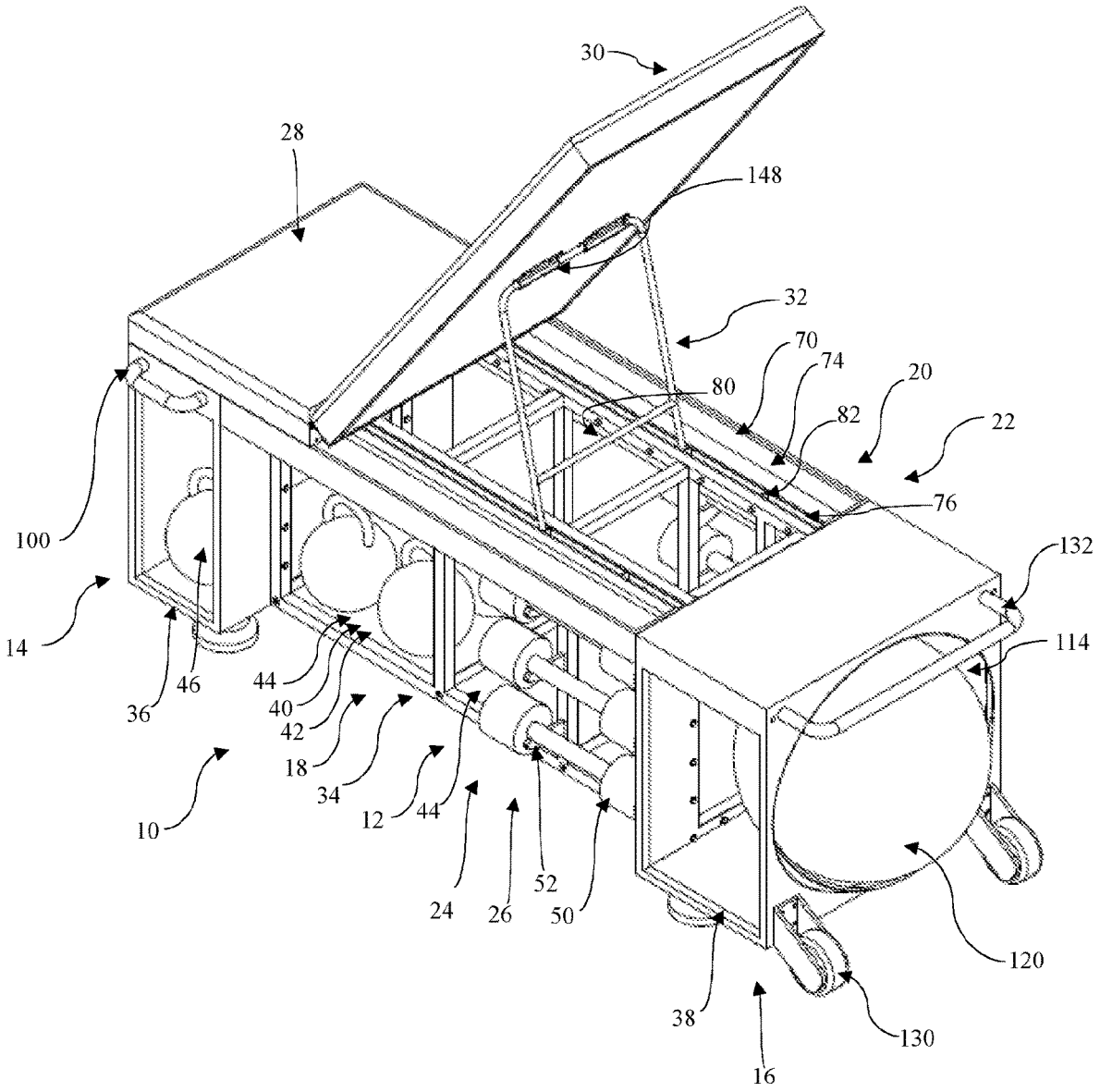

(51) Int. Cl.
*A63B 47/00* (2006.01)
*A63B 71/02* (2006.01)
*A63B 21/072* (2006.01)

(52) U.S. Cl.
CPC ..... *A63B 21/0726* (2013.01); *A63B 2071/025* (2013.01); *A63B 2208/0233* (2013.01); *A63B 2208/0242* (2013.01); *A63B 2210/00* (2013.01); *A63B 2210/50* (2013.01); *A63B 2225/09* (2013.01)

(58) Field of Classification Search
CPC ..... A63B 2210/00; A63B 2208/0233; A63B 2208/0242; A63B 2071/025; A63B 21/0726
See application file for complete search history.

(56) References Cited

U.S. PATENT DOCUMENTS 4,477,074 A 10/1984 Bushnell
5,575,742 A 11/1996 Wu
5,637,059 A 6/1997 Dalebout
6,245,001 B1 * 6/2001 Siaperas ..... A63B 21/04 482/123
6,454,683 B1 * 9/2002 Kaye ..... A47B 83/045 482/142
6,634,998 B2 * 10/2003 Siaperas ..... A63B 21/04 482/123
6,908,417 B2 * 6/2005 Jackson ..... A63B 21/0552 482/123
7,601,101 B2 * 10/2009 Jackson ..... A63B 21/04 482/142
7,614,988 B1 11/2009 Kiser
8,820,522 B2 * 9/2014 Quarry ..... A45C 5/04 206/315.1
8,900,074 B1 * 12/2014 Johnson ..... A63B 69/205 473/422
9,770,618 B2 * 9/2017 Wall ..... A63B 21/0552
D831,762 S * 10/2018 Donnelly ..... D21/690
10,092,791 B2 * 10/2018 Donnelly ..... A63B 21/0726
2007/0164525 A1 * 7/2007 Rodrigues ..... A45C 7/0054 280/47.18
2007/0270292 A1 * 11/2007 Laney ..... A63B 21/0552 482/121
2015/0328494 A1 * 11/2015 Matthews ..... A63B 21/4029 482/142
2016/0001116 A1 * 1/2016 Prusaitis ..... A63B 1/00 482/38
2016/0059104 A1 * 3/2016 Monaco ..... E04H 3/14 280/30

OTHER PUBLICATIONS

Written Opinion of the International Searching Authority for PCT/GB2017/051099 dated Aug. 9, 2017.

* cited by examiner

FITNESS-EQUIPMENT STORAGE BENCH

This application claims priority to U.S. Provisional Patent Application No. 62/325,370, which is hereby incorporated by reference.

The present invention relates to exercise benches, and more particularly, to exercise benches adapted for the easy storage of fitness equipment, hereafter referred to as fitness-equipment storage benches; or as group exercise support benches; or as group fitness exercise benches; or as group exercise benches.

Resistance training using weights is practiced worldwide, for athletic development, maintaining physical fitness and recreation. Common categories of weights used include barbells, dumbbells, kettlebells and medicine balls. Exercise benches are also commonly used in resistance training, especially in muscle-building exercises where the isolation of a specific group of muscles may be advantageous.

ISO standard 20957-1:2013 specifies general safety requirements and test methods for stationary training equipment, while ISO standard 20957-4:2016 specifies safety requirements for stationary strength training benches.

An inclined exercise plane may be beneficial, as it allows greater control of the muscle groups used in a given resistance training exercise. For example, inclined bench presses may result in greater development of the upper pectoral and deltoid muscles, whereas flat bench presses may target development of upper and lower pectoral muscles.

A wide range of resistance training exercises can be performed with an exercise bench, including, but not limited to, bench presses, pectoral flies, triceps kickbacks, dumbbell rows, bicep curls, leg curls, leg raises, and back extensions. Exercise benches may also be used for stretching exercises, or to aid practitioners of Hatha yoga.

Exercise benches are typically placed in physical-activity environments, such as gymnasia or sports halls, where maximising the amount of space available to users for exercise is important. Presently, fitness equipment, such as weights for resistance training, is commonly located against the walls of the physical-activity environment, or in designated storage units, away from the main physical-activity area. This is disadvantageous, as users exercising in the main physical-activity area may not have convenient access to the fitness equipment.

It is known to provide a fitness-equipment storage bench, by placing a chest under a pivotable back rest of an exercise bench. However, this design has several disadvantages. Firstly, it is not possible to access the stored fitness-equipment without adjusting the position of the back rest, which may result in loss of a desired prior inclination. Secondly, the storage of fitness equipment in a chest does not provide convenient access to the stored fitness equipment because when the chest is filled, items stored in the bottom of the chest are not accessible. Furthermore, the storage chest may preferably open with a different pivot axis to that desired for a pivotable backrest, but the provision of the storage chest lid as a separate pivotable component results in redundant components and a less intuitive method of accessing the chest.

Additionally, as physical fitness environments may be shared by various users with different preferred physical-fitness activities, it would be advantageous to provide an easily moveable fitness-equipment storage bench, to allow reorientation, movement and storage of the exercise storage-bench as required. For example, the fitness-equipment storage bench could be used in group fitness classes, where it may be advantageous to move or reorient the bench in order to allow a demonstration, or a calisthenics session, to take place. Known exercise benches with storage space are not designed to be easily moved.

There is no current solution for individual group fitness exercise stations that provide adjustable benches or seats, accessory or equipment storage, and are portable.

Other devices are limited in utility, by being stationary with their seat, as they do not offer storage, and as they are not stable enough to provide attachment points for other exercise equipment.

The group fitness exercise bench is designed for group fitness classes, and the bench may offer multiple positions of the bench of seat, and varied angles of inclination. It also provides a safe way to store accessories and equipment for the use of each exerciser and allows the bench to be relocated easily with casters and a handle so that it can be pulled to a different location.

The object of this invention is to provide solutions to all of the abovementioned problems with the prior art.

According to a first aspect of the invention there is provided a fitness-equipment storage bench for use in aiding or supplementing a physical activity in a physical-activity environment whilst enabling storage of fitness equipment, the fitness-equipment storage bench comprising a cuboidal or substantially cuboidal body having first and second ends, two opposing sides between the first and second ends, a top and a bottom; at least one recess formed in one of the said sides; at least one cantilevered bar support in the recess for supporting a dumbbell such that a support axis is located entirely within the recess; at least one rotatable element at or adjacent to the first end or the second end to facilitate reorientation of the bench; a pivotable user back support on the top of the cuboidal body; and a stay associated with the back support to hold the back support in at least one raised condition.

Preferably, there may be at least one recess formed in each of the said sides. A plurality of side recesses provides a greater available storage volume for fitness equipment.

Likewise, there may also be beneficially provided at least one end recess in one of the said ends for housing fitness equipment.

The said end recess may have a non-circular access opening to push-fit captively hold ball-shaped exercise equipment. Advantageously, this allows accessible and secure storage of one or more balls or other ball-shaped exercise equipment within the end recess.

In this case, there may beneficially be provided a curved apron at or adjacent to a lower edge of the access opening to promote ingress and egress of said ball-shaped exercise equipment. A second opening opposite to the access opening may also be provided to allow storage of oversized ball-shaped exercise equipment in the end recess.

There may preferably be a beaded surface on a projecting free edge of the curved apron. The beaded surface increases the friction between an item of ball-shaped exercise equipment and the projecting free edge of the curved apron, improving user control of an item of ball-shaped exercise equipment's movement as it is manually removed from or inserted through the access opening.

The distance between the first and second ends of the fitness-equipment storage bench may preferably define or substantially define a longitudinal extent of the fitness-equipment storage bench. This layout of the exercise bench is advantageous, as it may allow the storage areas suitable for the most commonly used items of resistance training equipment, dumbbells and kettlebells, being easily accessible to the user of the fitness-equipment storage bench as a resistance-training bench.

The body of the fitness-equipment storage bench may beneficially comprise a modular frame. The use of a modular frame may allow easy assembly of the fitness-equipment storage bench, especially if custom modifications to the layout are desired, and allow compact transport due to the possibility of flat-packed storage. Furthermore, the use of a frame as a chassis may aid lightweight construction and thus increases the portability of the fitness-equipment storage bench.

The modular frame may comprise a plurality of side frame units, and a plurality of cross members which interconnect the side frame units, advantageously allowing provision of the fitness-equipment storage bench in flatpack form.

Optionally, the body may comprise two end units attached to the modular frame to provide the ends of the body. This may provide alternative options in the construction of the body, by allowing interchange of the positions of the end units with respect to the modular frame.

Preferably the said cantilevered bar supports form a rack, which is integral with the said modular frame, for a plurality of dumbbells. A dumbbell rack in the recess which can store a plurality of dumbbells is advantageous, as it allows compact storage close to the modular frame, without obstruction of desired physical-fitness manoeuvres.

The fitness-equipment storage bench may include at least one side tray, located at least in part under the user back support, which beneficially provides additional storage space under the backrest.

The recess may be defined by the modular frame and the said at least one side tray. A recess defined by the modular frame and a side tray is preferable as it allows economic construction of the fitness-equipment storage bench, as no otherwise redundant components are required to define the recess.

The or each side tray may beneficially include a channel for receiving the stay to support the back support in one or more raised conditions. Beneficially, this allows the user to control the inclination of the back support, without requiring the provision of a separate stay receiving component.

In this case, the or each side tray may further include at least one storage compartment partitioned from the said channel, to avoid the movement of the stay from disturbing equipment stored in the said side tray.

To allow the back support to be fixed in a predetermined inclined position, there may preferably be provided at least one stop for the stay in the said at least one side tray.

There may most preferably be provided at least two side trays in which the stay can be received, to allow accommodation of a two-legged stay.

The fitness-equipment storage bench may comprise a seat element which is at or adjacent to the back support and relative to which the back support is pivotable. This allows the user to sit on the bench, and increases the range of exercises which can be performed. For instance, a fitness-equipment storage bench with a seat and an inclinable back support, may assist a user to perform arm curls sitting on the seat, with support to the user's back, which is not possible with a fitness-equipment storage bench with only an inclinable back support.

There may be at least one handle at or adjacent to one or more of the said ends of the fitness-equipment storage bench. The handle or handles may advantageously aid reorientation or relocation of the fitness-equipment storage bench.

The fitness-equipment storage bench may comprise a plurality of side-accessible storage compartments. This allows access to stored fitness equipment without requiring the inclination of the back support to be changed, and may allow access to stored fitness equipment while the fitness-equipment storage bench is in use.

To reduce costs, and allow custom modular construction, the fitness-equipment storage bench may be provided as a kit of parts. It may be particularly preferable to provide the fitness-equipment storage bench in flat pack form, to allow compact transport and warehouse storage of the fitness-equipment storage bench.

According to a second aspect of the invention there is provided a fitness-equipment storage bench for use in aiding or supplementing a physical activity in a physical-activity environment whilst enabling storage of fitness equipment, the fitness-equipment storage bench comprising: an elongate body having first and second ends, at least two opposing sides between the first and second ends, a top and a bottom; at least one recess formed in one of the said sides; a pivotable user back support on the top of the body; at least one bar support in the recess for supporting a dumbbell such that a support axis is located entirely within the recess.

Figure 2A:
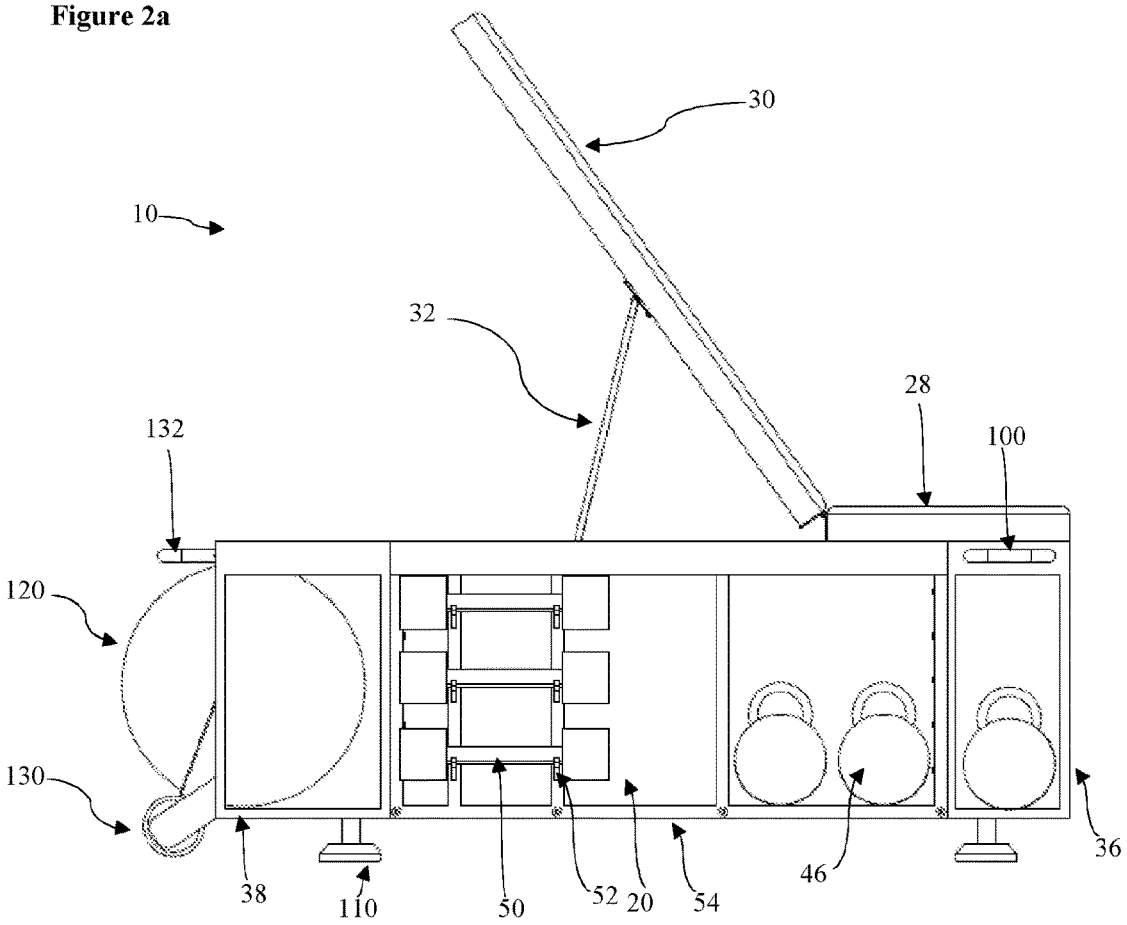
Figure 2B:
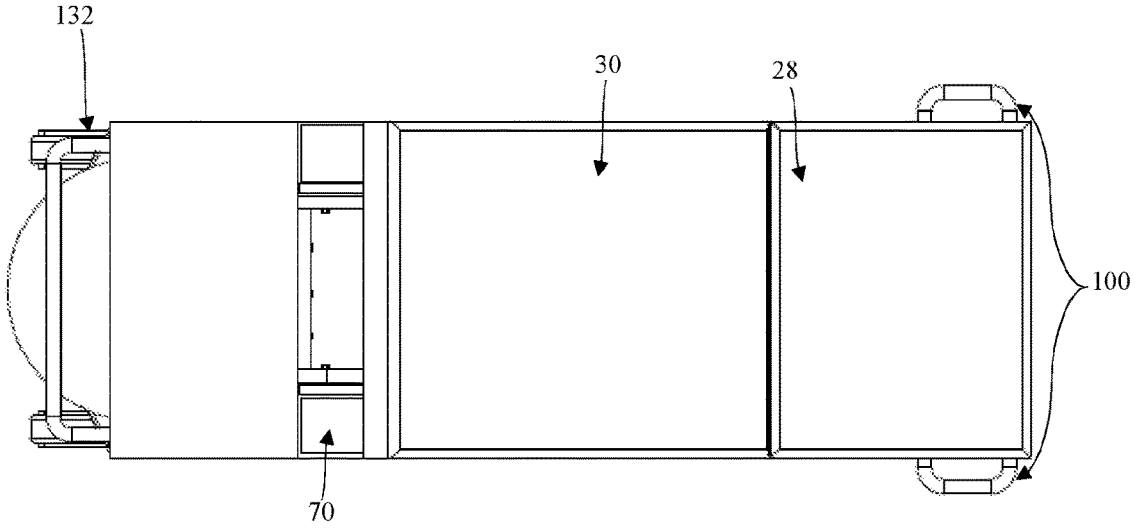
Figure 3A:
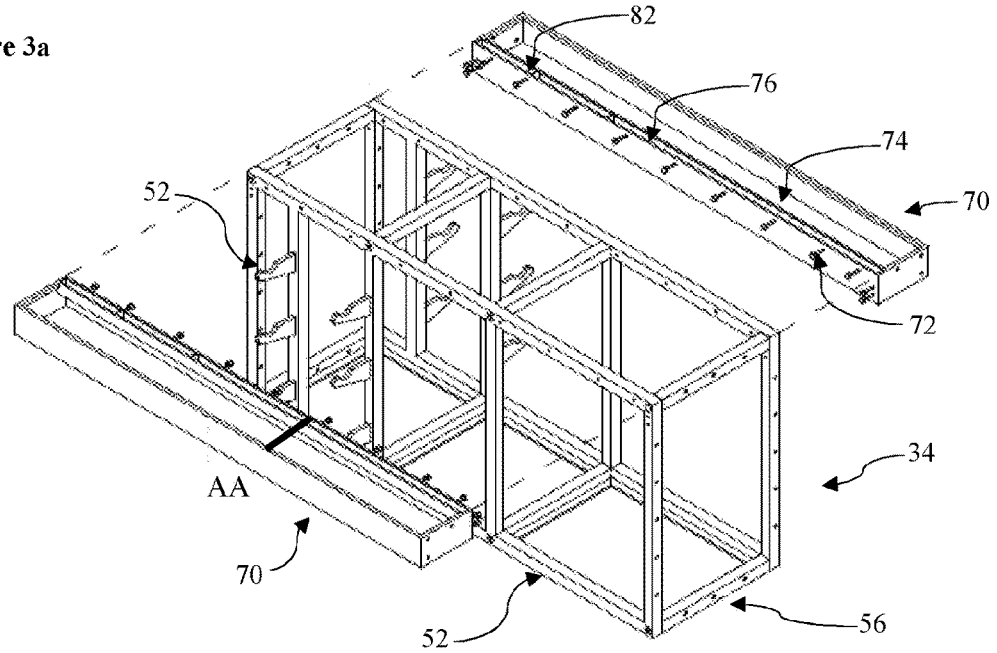
Figure 3B:
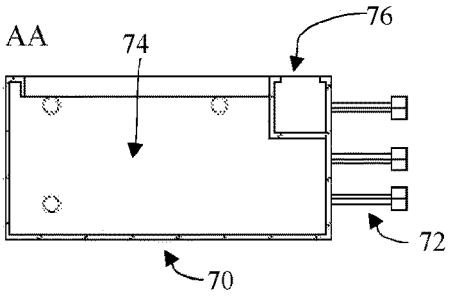
Figure 3C:
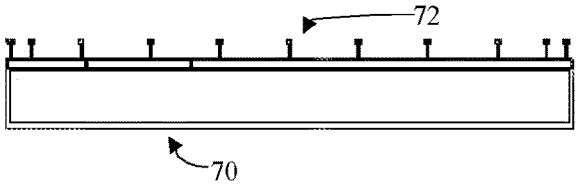

The invention will now be more particularly described, by way of example only, with reference to the accompanying drawings, in which:

FIG. 1 shows a perspective view of one embodiment of a fitness-equipment storage bench in accordance with the first and second aspects of the invention;

FIG. 2*a* shows a lateral view of the embodiment of a fitness-equipment storage bench shown in FIG. 1;

FIG. 2*b* shows a upper plan view of the embodiment of a fitness-equipment storage bench shown in FIG. 1;

FIG. 3*a* shows an exploded view of the modular frame and side trays of the embodiment of a fitness-equipment storage bench shown in FIG. 1;

FIG. 3*b* shows a lateral cross-sectional view of a side tray of the embodiment of a fitness-equipment storage bench as shown in FIG. 3*a*, along the cross-section A-A;

FIG. 3*c* shows a upper plan view of a side tray, as shown in FIG. 3*a;*

Figure 3D:
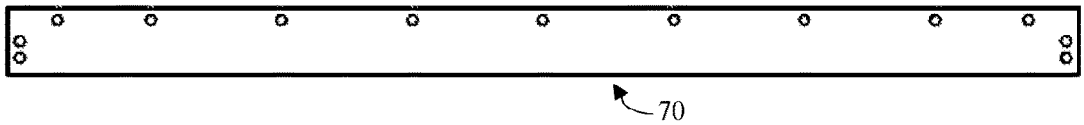

FIG. 3*d* shows a lateral view of a side tray, as shown in FIG. 3*a;*

Figure 3E:
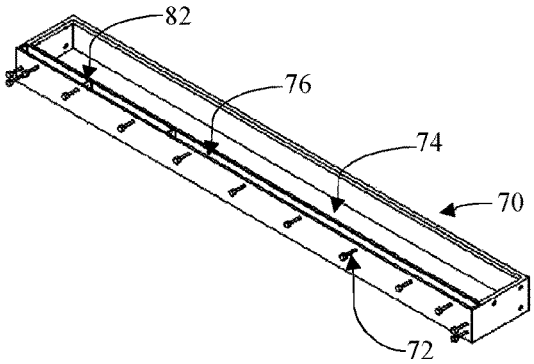

FIG. 3*e* shows a perspective view of a side tray, as shown in FIG. 3*a;*

Figure 3F:
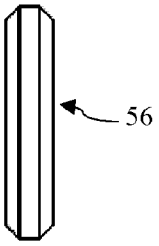

FIG. 3*f* shows a first perspective view of a double-ledged cross member, of the modular frame shown in FIG. 3*a;*

Figure 3G:
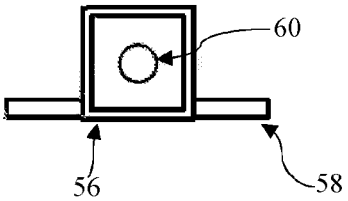

FIG. 3*g* shows a plan view of the double-ledged cross member shown in FIG. 3*f;*

Figure 3H:
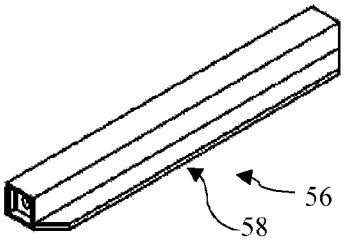

FIG. 3*h* shows a second perspective view of the double-ledged cross member shown in FIG. 3*g;*

Figure 3I:
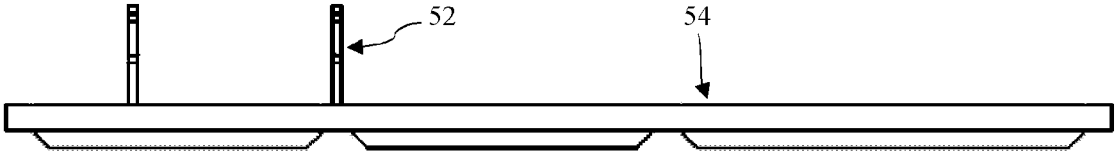

FIG. 3*i* shows an upper plan view of a side frame unit of the modular frame shown in FIG. 3*a;*

Figure 3J:
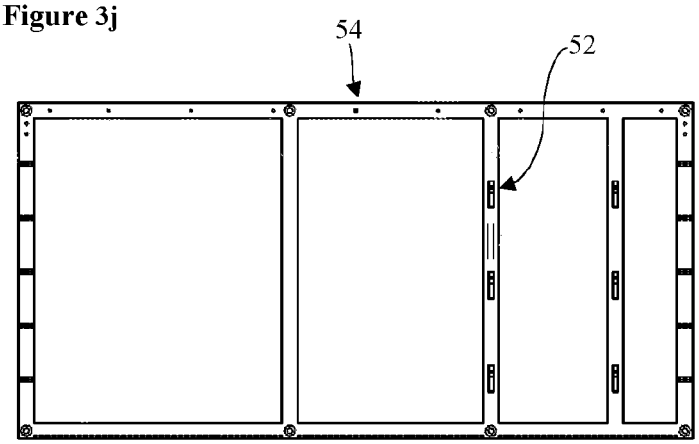

FIG. 3*j* shows a front-on view of the side frame-unit shown in FIG. 3*i;*

Figure 3K:
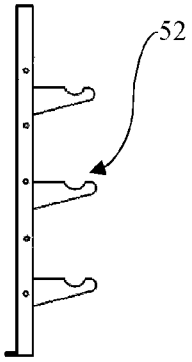

FIG. 3*k* shows a profile view of the side-frame-unit shown in FIG. 3*i;*

Figure 3L:
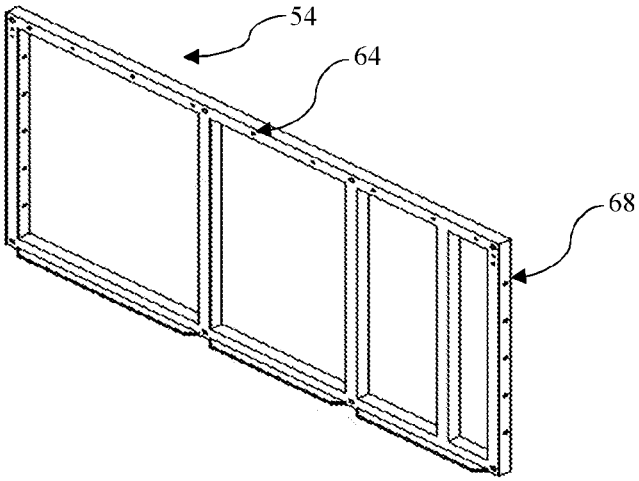

FIG. 3*l* shows a perspective view of the side-frame unit shown in FIG. 3*i;*

Figure 3M:
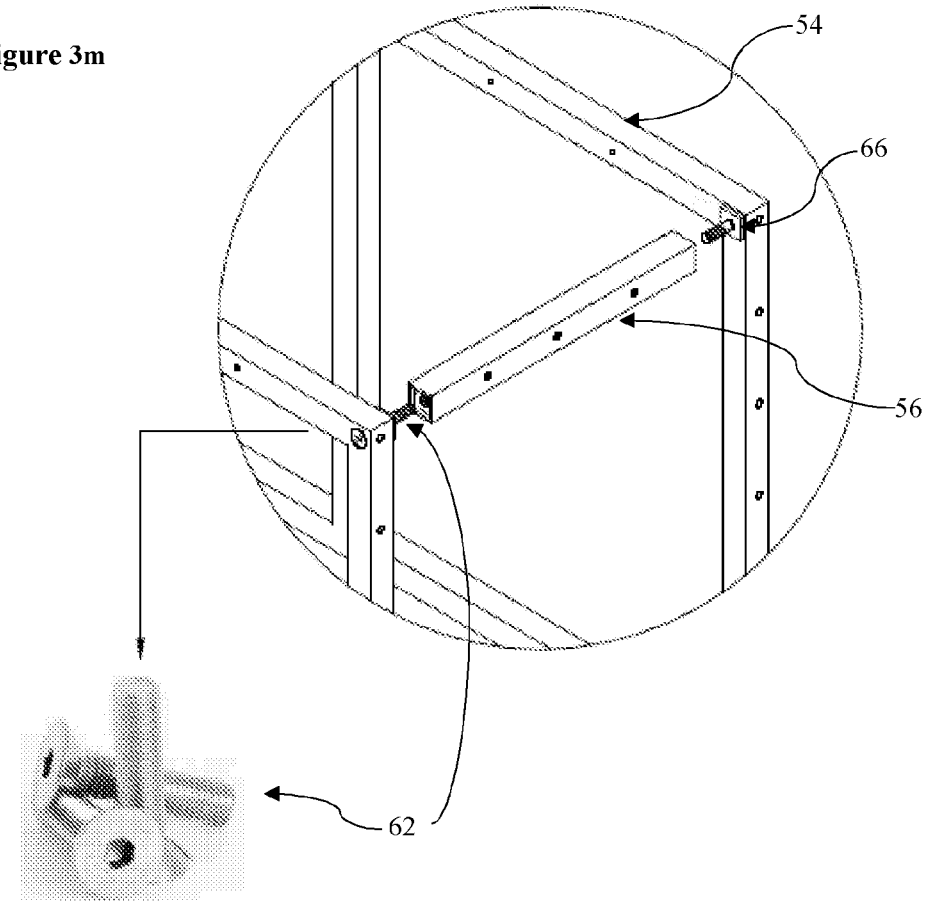
Figure 3N:
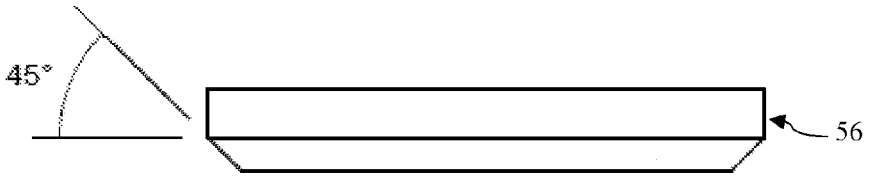

FIG. 3*m* shows a partially exploded detail of the modular frame shown in FIG. 3*a*, revealing one possible embodiment of the screw-threaded connections between the cross members and the side frame units;

FIG. 3*n* shows a first perspective view of a single-ledged cross member for the modular frame shown in FIG. 3*a;*

Figure 3O:
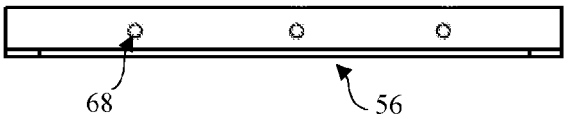

FIG. 3*o* shows a lateral view of the single-ledged cross member shown in FIG. 3*n;*

Figure 3P:
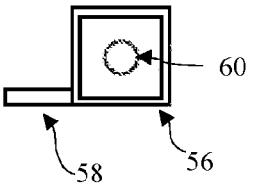

FIG. 3*p* shows a plan view of the single-ledged cross member shown in FIG. 3*n;*

Figure 3Q:
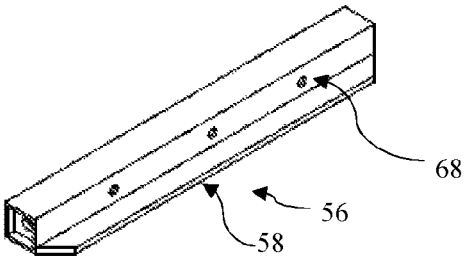

FIG. 3*q* shows a second perspective view of the single-ledged cross member shown in FIG. 3*n;*

Figure 3R:
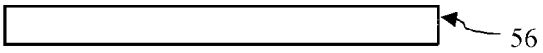

FIG. 3*r* shows a first lateral view of a first non-ledged cross member with three lateral apertures, for the modular frame shown in FIG. 3*a;*

Figure 3S:
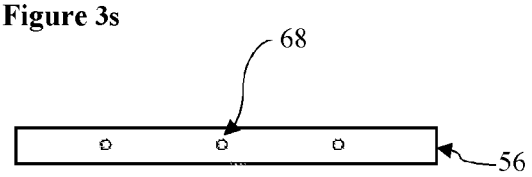

FIG. 3*s* shows a second lateral view of the non-ledged cross member shown in FIG. 3*r;*

Figure 3T:
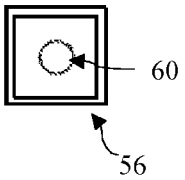

FIG. 3*t* shows a plan view of the non-ledged cross member shown in FIG. 3*r.*

Figure 3U:
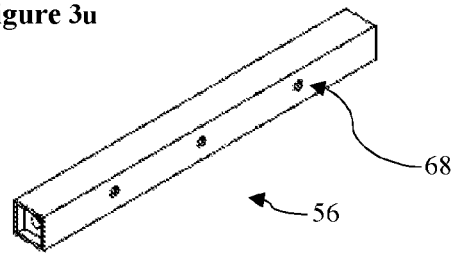

FIG. 3*u* shows a perspective view of the non-ledged cross member shown in FIG. 3*r;*

Figure 3V:
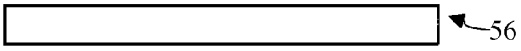

FIG. 3*v* shows a first lateral view of a second non-ledged cross member without lateral apertures, for the modular frame shown in FIG. 3*a;*

Figure 3W:
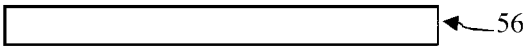

FIG. 3*w* shows a second lateral view of the non-ledged cross member shown in FIG. 3*v;*

Figure 3X:
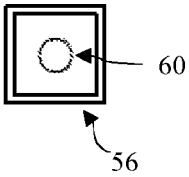

FIG. 3*x* shows a plan view of the non-ledged cross member shown in FIG. 3*v;*

Figure 3Y:
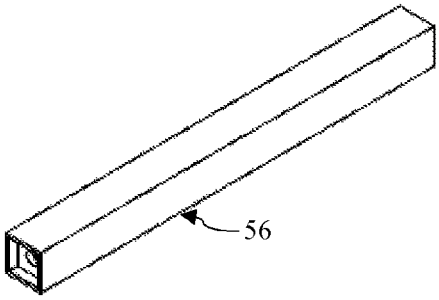

FIG. 3*y* shows a perspective view of the non-ledged cross member shown in FIG. 3*v;*

Figure 3Z:
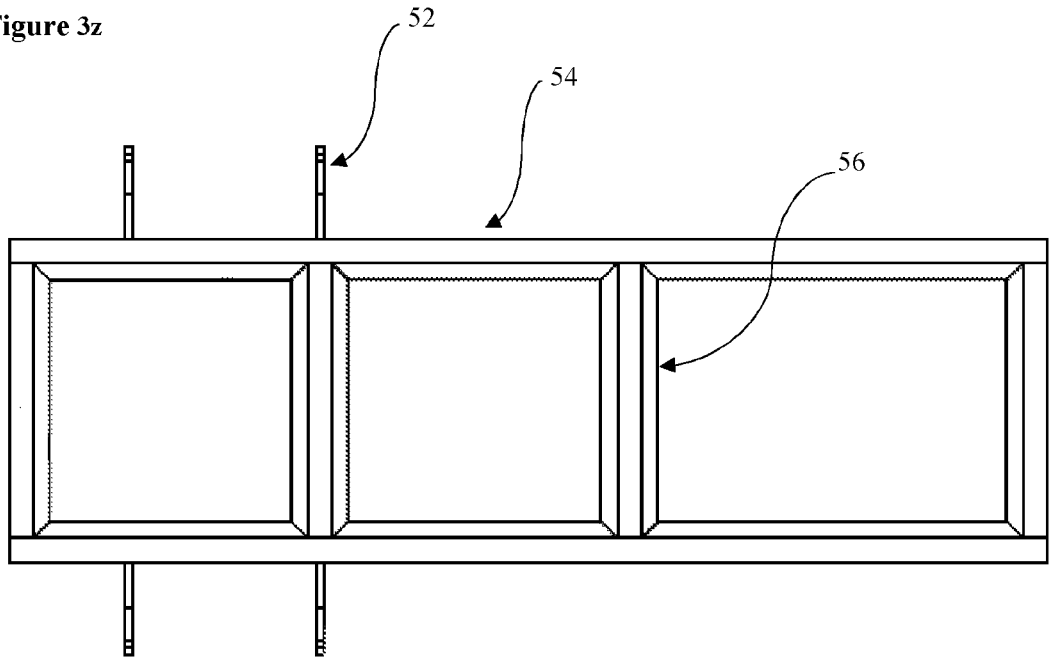
Figure 3A:
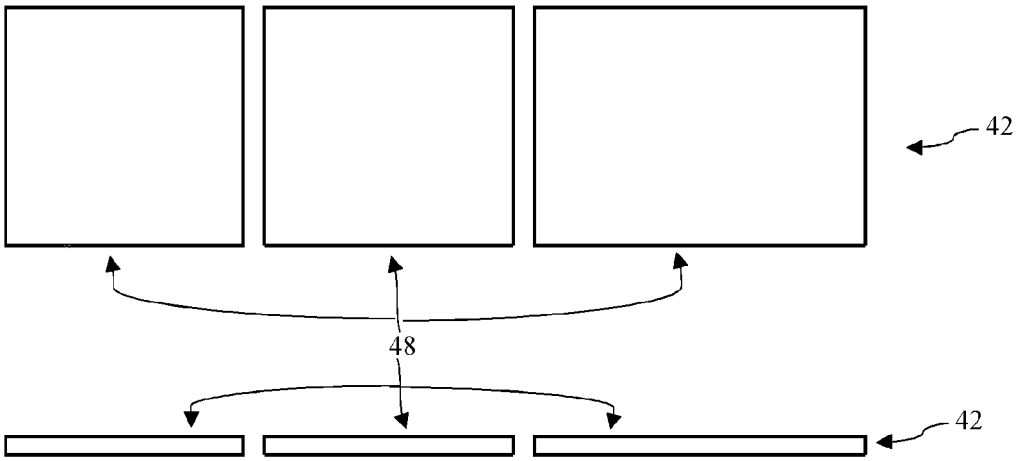

FIG. 3*z* shows a plan view of the modular frame shown in FIG. 3*a;*

FIG. 3*aa* shows plan and lateral views of the base for the modular frame shown in FIG. 3*a;*

Figure 4A:
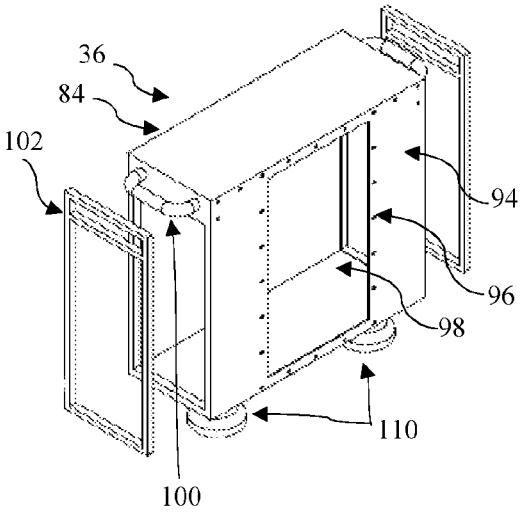
Figure 4B:
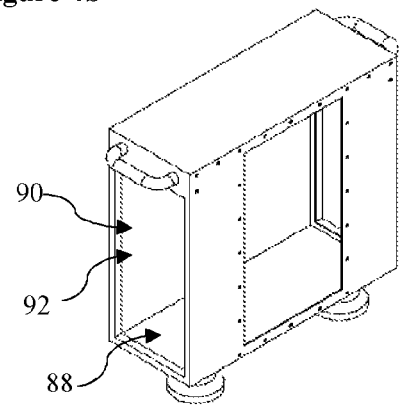

FIG. 4*a* shows a partially exploded perspective view of a first end unit of the embodiment of a fitness-equipment storage bench shown in FIG. 1;

FIG. 4*b* shows a perspective view of the first end unit shown in FIG. 4*a;*

Figure 4C:
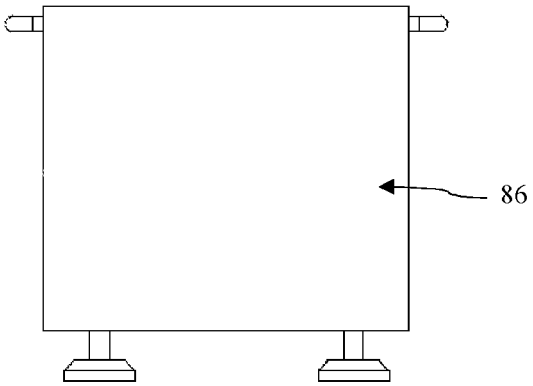

FIG. 4*c* shows an end-on view of the first end unit shown in FIG. 4*a;*

Figure 4D:
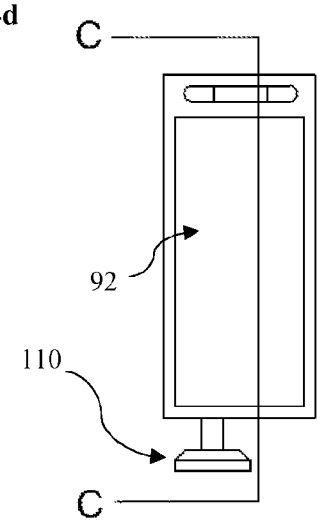
Figure 4E:
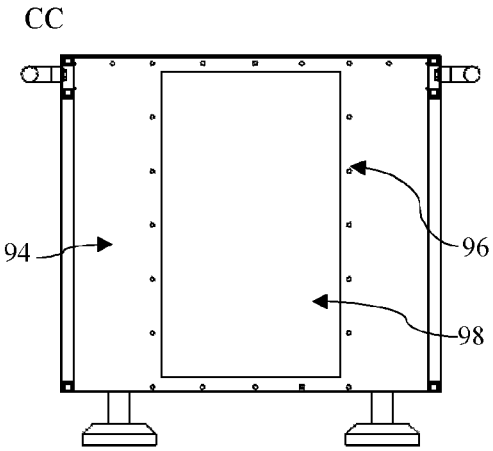

FIG. 4*d* shows a lateral view of the first end unit shown in FIG. 4*a*, indicating the cross-section C-C;

FIG. 4*e* shows the cross-section C-C of the first end unit shown in FIG. 4*a;*

Figure 4F:
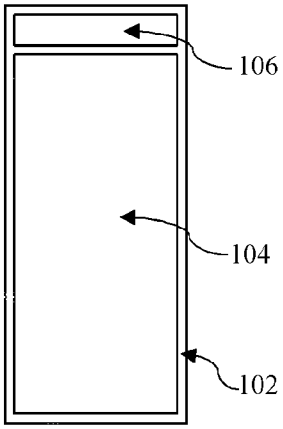

FIG. 4*f* shows an internal frame of the first end unit shown in FIG. 4*a;*

Figure 4G:
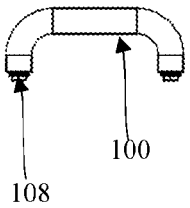

FIG. 4*g* shows a handle of the first end unit shown in FIG. 4*a;*

Figure 5A:
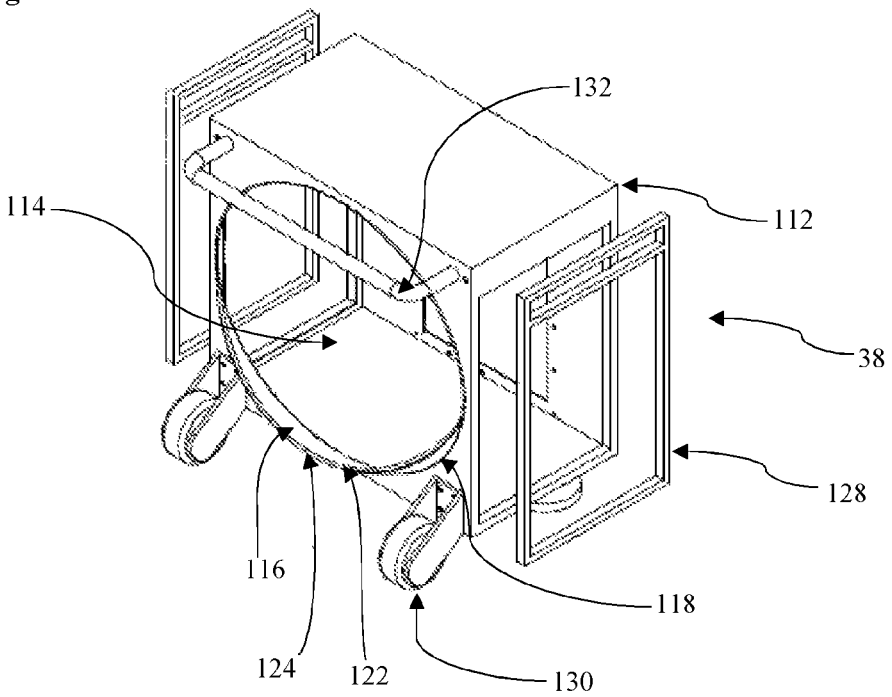
Figure 5B:
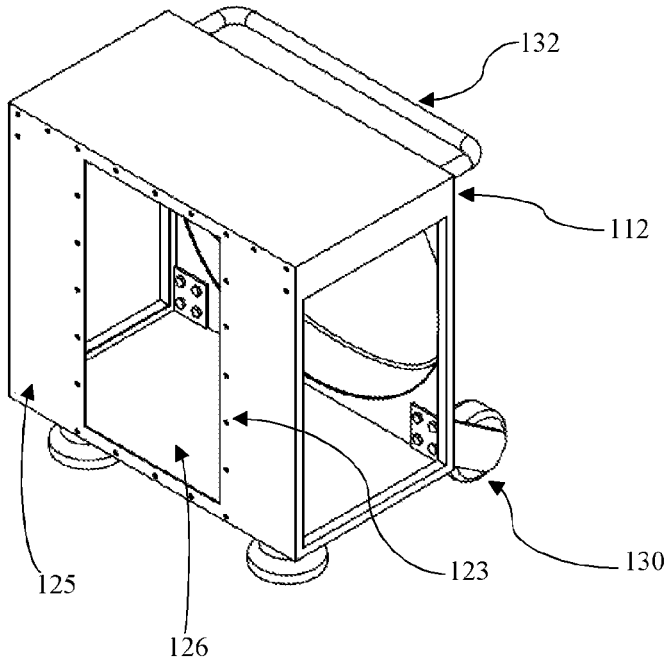

FIG. 5*a* shows a partially exploded perspective view of a second end unit of the embodiment of a fitness-equipment storage bench shown in FIG. 1;

FIG. 5*b* shows a second perspective view of the second end unit shown in FIG. 5*a;*

Figure 5C:
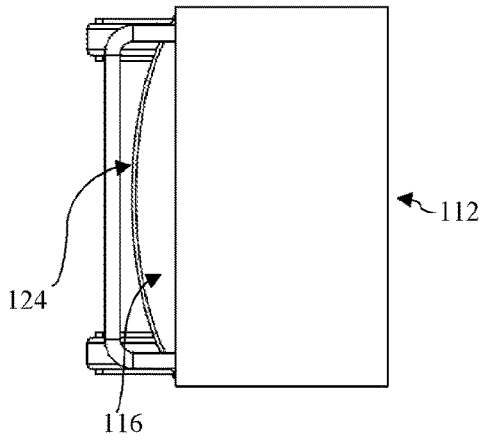

FIG. 5*c* shows a top plan view of the second end unit shown in FIG. 5*a;*

Figure 5D:
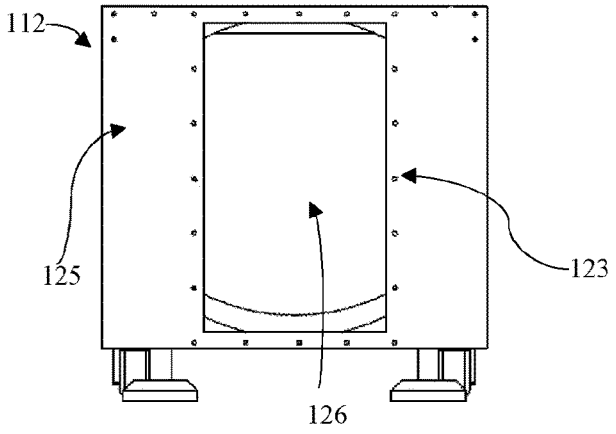

FIG. 5*d* shows an end-on view of the second end unit shown in FIG. 5*a;*

Figure 5E:
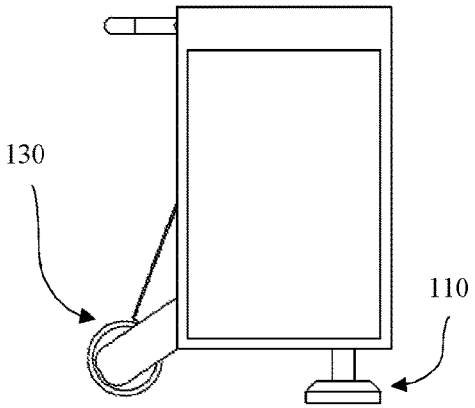

FIG. 5*e* shows a lateral view of the second end unit shown in FIG. 5*a;*

Figure 5F:
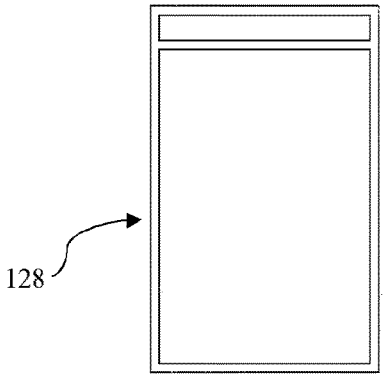

FIG. 5*f* shows an internal frame of the second end unit shown in FIG. 5*a;*

Figure 5G:
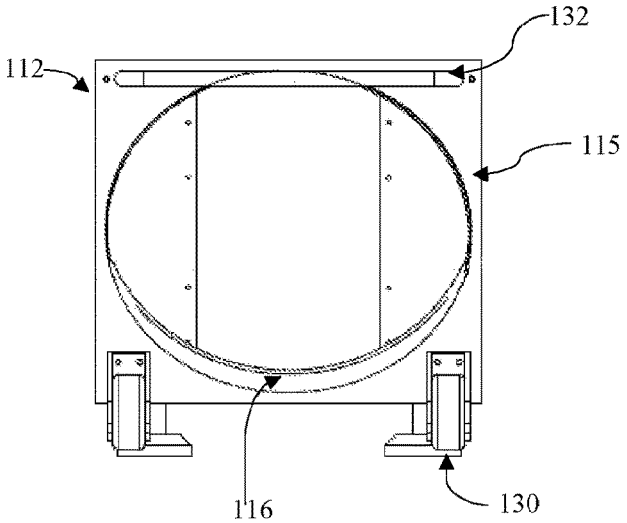

FIG. 5*g* shows a second end-on view of the second end unit shown in FIG. 5*a;*

Figure 5H:
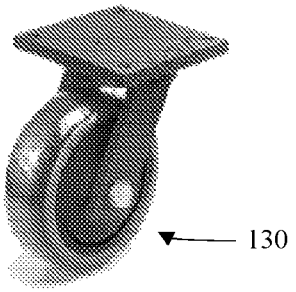

FIG. 5*h* shows a perspective view of one possible caster design for the second end unit shown in FIG. 5*a;*

Figure 5I:
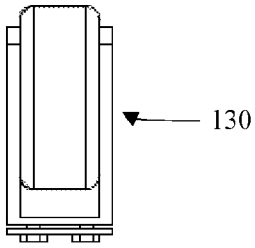
Figure 5J:
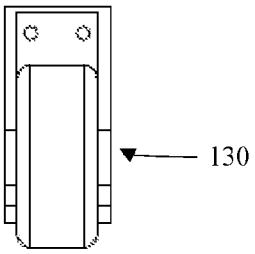

FIG. 5*i* shows a plan view of a second possible caster design for the second end unit;

FIG. 5*j* shows an end-on view of the caster shown in FIG. 5*i;*

Figure 5K:
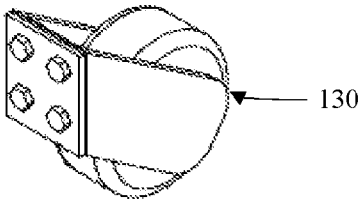

FIG. 5*k* shows a perspective view of the caster shown in FIG. 5*i;*

Figure 5L:
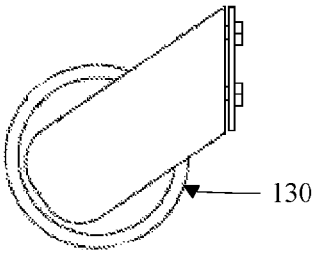

FIG. 5*l* shows a lateral view of the caster shown in FIG. 5*i;*

Figure 5M:
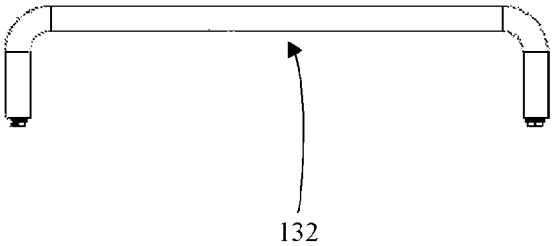

FIG. 5*m* shows the handle of the second end unit shown in FIG. 5*a;*

Figure 6A:
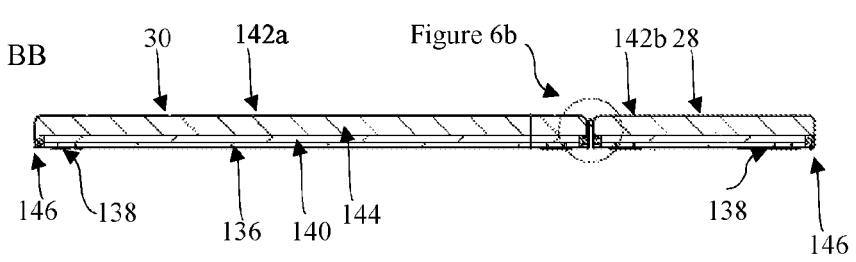
Figure 6C:
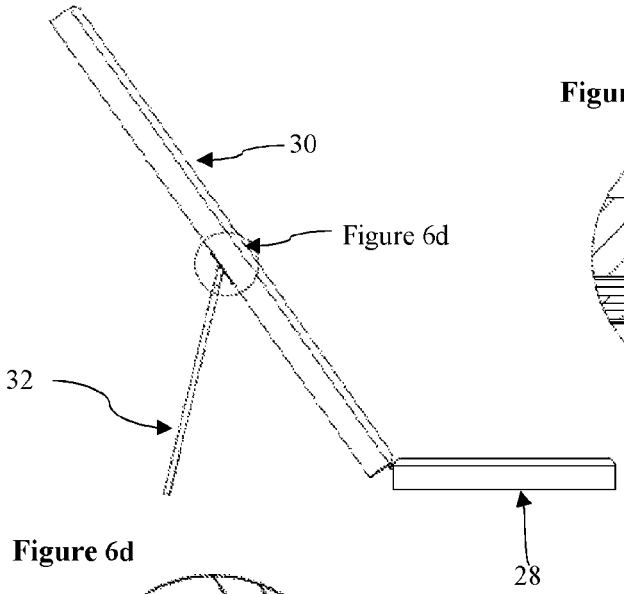
Figure 6B:
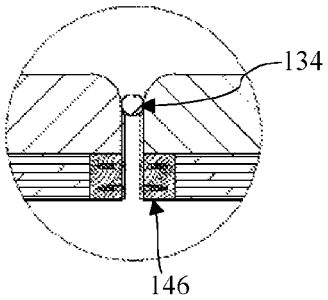
Figure 6D:
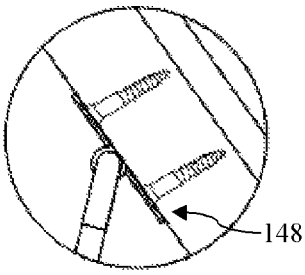
Figure 6E:
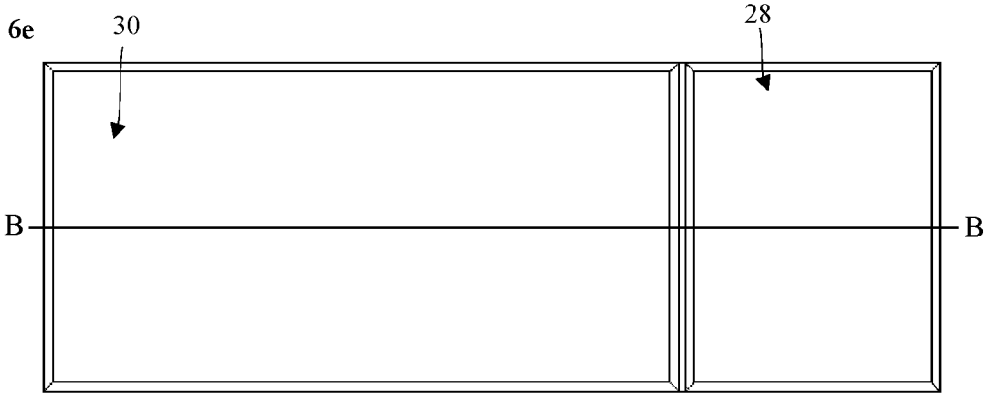
Figure 6F:
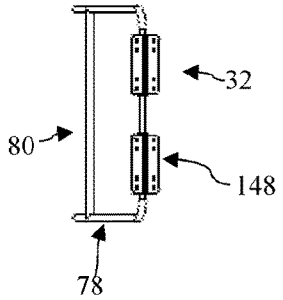

FIG. 6*a* shows the cross-section B-B of the seating area and back rest of the embodiment of a fitness-equipment storage bench shown in FIG. 1, in the flat position;

FIG. 6*b* shows a detail of FIG. 6*a*, indicating a possible hinged connection between the seat and the backrest;

FIG. 6*c* shows a lateral view of the seating area and back rest shown in FIG. 6*a*, in an inclined position;

FIG. 6*d* shows a detail of FIG. 6*c*, indicating a possible connection of the stay to the back rest via a hinge;

FIG. 6*e* shows an upper plan view of the seat and backrest of FIG. 6*a*, indicating the cross-section B-B;

FIG. 6*f* shows a first perspective view of the stay and hinges shown in FIG. 6*c* and FIG. 6*d;*

Figure 6G:
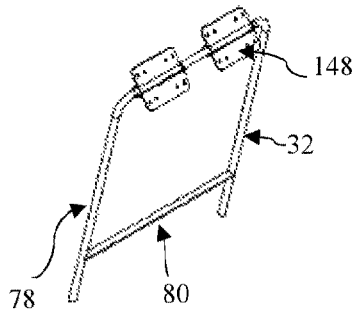

FIG. 6*g* shows a second perspective view of the stay and hinges shown in FIG. 6*c* and FIG. 6*d;*

Figure 6H:
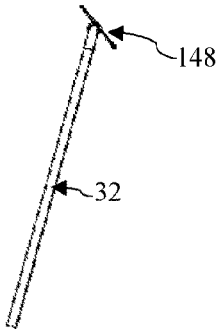

FIG. 6*h* shows a lateral view of the stay and hinges shown in FIG. 6*c* and FIG. 6*d;*

Figure 6I:
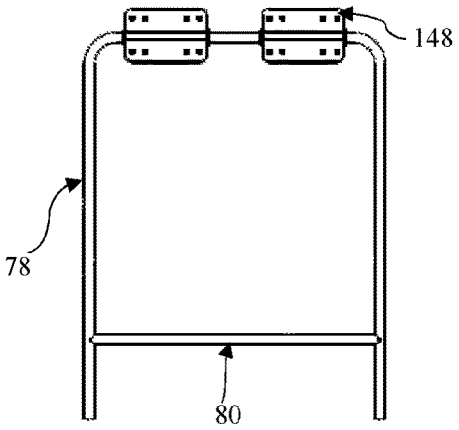

FIG. 6*i* shows a plan view of the stay and hinges shown in FIG. 6*c* and FIG. 6*d;*

Figure 6J:
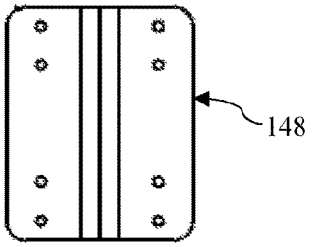

FIG. 6*j* shows a top plan view of a hinge shown in FIG. 6*d;*

Figure 6K:
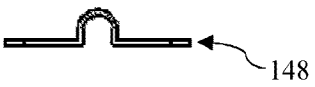

FIG. 6*k* shows a lateral view of the hinge shown in FIG. 6*j;*

Figure 6L:
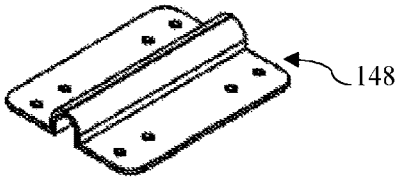

FIG. 6*l* shows a perspective view of the hinge shown in FIG. 6*j;*

Figure 7A:
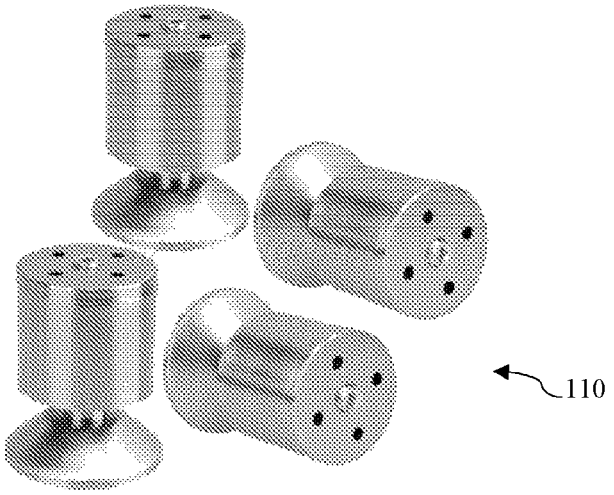
Figure 7B:
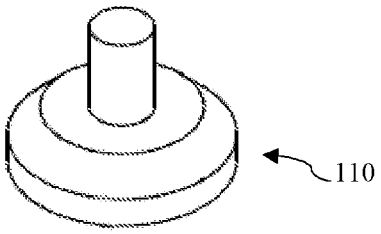

FIG. 7*a* shows a perspective view of a plurality of adjustable feet suitable for a fitness-equipment storage bench according to the first and second aspects of the invention; and FIG. 7*b* shows a perspective view of a lower portion of an adjustable foot, as shown in FIG. 7*a*.

All non-SI units of length hereinafter used, are, for the avoidance of doubt, US customary units, whereby one inch is equivalent to 25.4 mm, as defined by the American National Standards Institute.

Referring to the drawings, there is shown a fitness-equipment storage bench 10, having a body 12 with first and second ends 14, 16, two opposing sides 18, 20 between the first and second ends 14, 16, a top 22 and a bottom 24, recesses 26 formed in the said sides 18, 20, a seat 28, and a pivotable backrest 30, which can be fixed in one or more inclined position with a stay 32.

The fitness-equipment storage bench 10 is adapted to store fitness equipment compactly and accessibly. There is provided a middle frame or framework, hereinafter referred to as a central frame 34, and two end units 36, 38, all of which include storage compartments 40 adapted to store specific categories of fitness equipment. The central frame 34 may be laterally recessed with respect to the end units 36, 38 and the top of the fitness-equipment storage bench 10, and may preferably define a plurality of storage compartments 40.

The central frame 34 may have a floor pan or floor, hereinafter referred to as a base 42, and at least two side-accessible storage compartments 44. These side-accessible central frame storage compartments 44 are particularly suitable for the storage of flat-based kettlebells 46, as shown. Where flat-shelved compartments 44 are provided, storage of a wide variety of other fitness equipment may be appropriate, as long as said equipment can be rested on a flat surface. For instance, one could use the side-accessible central frame storage compartments 44 to store weight plates for adjustable dumbbells or barbells, or handles and cables for cable resistance training machines. The compartments 44 could also be used to store other weight training accessories, such as bench vests. Alternatively, the dumbbells may be receivable within a recess, while the bar supports are at least in part flush with the end units.

The base 42 can preferably be provided as plywood shelving, and may be provided as a single base element 48 extending along the full extent of the base of the central frame, or as a plurality of base elements 48, for instance, one for each storage compartment 40. The plywood shelving could be reinforced, for example with fibreglass, and/or finished with a coating, such as an enamel coating.

The central frame 34 also preferably includes one or more side storage racks, adapted to hold dumbbells 50, hereinafter referred to as bar supports 52. The bar supports 52 are preferably cantilevered and located entirely within the recess 26 defined by the central frame 34 with respect to the end units 36, 38 and the top 22 of the fitness-equipment storage bench 10, such that a grip axis of the dumbbell 50 is received entirely within the recess, in alignment with a coterminous support axis defined on the upper surface of the or each supports 52. This is advantageous, as it prevents the user from being obstructed by stored dumbbells 50 during exercise, for instance when performing a kneeling dumbbell row on the bench. Various shapes of cantilevered bar supports 52 may be considered, but preferably they may be provided as elongate elements with a curvate recess 54 to lie therein the bar of a dumbbell 50. As shown, a pair of cantilevered bar supports 52 may be used to hold each dumbbell 50 proximal to its plates, so that the dumbbell 50 cannot move horizontally when stored. The bar supports 52 may be interchangeable with other storage means for versatility of storage.

To allow compact and accessible storage of multiple dumbbells, there may optionally be provided a plurality of cantilevered bar supports arranged in a ranked or nested fashion. In this case, preferably the largest dumbbells may be located on a lower pair of cantilevered bar supports, which may extend further from the central frame than higher pairs of cantilevered bar supports provided for smaller dumbbells. This arrangement is advantageous, as the smaller dumbbells may have grip axes received entirely within the recess, preventing obstruction of users during exercise, while larger dumbbells may be allowed to extend from the recess without compromising the user's freedom of movement. Additionally, if a user moving the fitness-equipment storage bench accidentally displaces one or more dumbbells, this arrangement ensures that the heaviest dumbbells fall the smallest distance to the floor, reducing the risk of damaging the floor of the physical-fitness environment.

The cantilevered bar supports 52 may be located on either or both sides of the central frame 34. In this case, if the cantilevered bar supports 52 are located on either side of the same storage compartment 40 of the central frame 34, the said storage compartment 40 may not be side-accessible. For this reason, the cantilevered bar supports 52 may advantageously be located on either side of a storage compartment 40 of the central frame 34, such that the storage compartment 40 is accessible through the top of the central frame 34, when the backrest 30 is in an inclined position. A storage compartment 40 in the central frame 34, located between two ranks of cantilevered bar supports 52, could advantageously be used to store a variety of exercise equipment. As well as kettlebells 46 and other such resistance training equipment, it may be preferable to store a small medicine ball or balls in this storage compartment, as the stored dumbbells 50 would prevent the medicine ball from rolling out of the side of the central frame 34.

The central frame 34 preferably may be provided as a modular frame, having two side frame units 54 connected by a plurality of elongate cross members 56 or struts. The cantilevered bar supports 52 may be integrally formed on the front surfaces of the side frame units 54, for strength of the supports 52. Both the side frame units 54 and the cross members 56 may be formed from mild steel, preferably formed as struts or tubes, for strong and lightweight construction. This design is particularly advantageous, as it may allow the central frame 34 to be flat-packed.

To maximize the space available inside the central frame 34 for fitness equipment storage, the cross members 56 may preferably connect the side frame units 54 at their tops and at their bases. Most preferably, two sets of four cross members 56 may span the side frame units 54 at top, and at bottom, as shown. The base of each side frame unit 54 may feature one or more ledges 58 to provide support to the base 42. The cross members 56, which join the two side frame units 54 at the base may also feature at least one corresponding ledge 58, so that a base 42 with rectangular cross-section can be supported on four sides by the ledges 58 of the central frame 34. Each ledge 58 may most preferably have a thickness of 0.3175 cm (⅛ inch), and extend 1.27 cm (½ inch) from its respective side frame unit or cross member, while the side frame units 54 and cross members 56 may have a thickness of 1.906 cm (¾ inch) in both square cross-sectional dimensions.

Preferably, the cross members 56 may have on either side a connection means such as a screw-threaded insert 60 which is parallel to their longitudinal extent. This allows each cross member 56 to be attached to two side frame units 54, via two screw-threaded fasteners 62 which each pass through an aperture 64 on a side frame unit 54 and into a screw-threaded insert 60 of a cross member 56. There may also be a locating piece 66 located at or adjacent to each aperture 64 of each side frame unit 54, receivable into a screw-threaded insert 60 of an appropriate cross member 56 to facilitate correct assembly of the central frame 34. The locating piece 66 may be provided as a 0.135 cm (⅛ inch) thick square plate, welded to the side frame unit 54.

The cross members 56 may preferably be provided from 1.905 cm (¾ inch) diameter square hollow section mild steel tubing, with wall thickness 0.15875 cm (1/16 inch).

The side frame units 54 and cross members 56 may have a plurality of further apertures 68, which may be screw-threaded, to allow the attachment of the end units 36, 38 and one or more side trays 70, via fasteners 72 receivable in the said further apertures. The fasteners 72 may be designed to be fastened with a hex key or screwdriver, to simplify assembly. The fasteners 72 for each side tray 70 may be welded to the side tray 70, and then simply fastened to the side frame units 54 with nuts, for ease of assembly. Other attachment means, such as one or more snap-fit interfaces, or locking detent pins, may also be considered.

Preferably two side trays 70 are provided, each attachable to the central frame 34 at the top of a side frame unit 54, so that the side trays 70 span the longitudinal extent of the central frame 34, and are located at least in part beneath the backrest 30 when the fitness-equipment storage bench 10 is fully assembled. The side trays 70 may be formed from mild steel, preferably from 0.15875 cm (1/16 inch) thick sheet metal. Each side tray 70 may have a main elongate storage compartment 74, suitable for storing resistance training accessories, such as ropes, exercise bands and tubes, and removable weight machine handles.

At one lateral end of the elongate storage compartment 74, there may be provided a channel 76. The channel 76 may be an open-topped tube, and preferably extends along the full length of the elongate storage compartment 74. Most preferably 76, the channel may be provided from square hollow section (SHS) mild steel tubing, with channel diameter 1.905 cm (¾ inch), and wall thickness 0.15875 cm (1/16 inch). The side tray 70 and/or channel 76 may be coated with an epoxy resin, with an appropriate undercoat, and the fasteners nickel plated or chrome finished to prevent corrosion.

The swing bar or backrest support bracket, hereinafter referred to as the stay 32, of the inclinable backrest 30 is preferably receivable in the channel 76. Most preferably, the stay 32 has two legs 78, each of which is receivable into a channel 76 of a side tray 70 on either side of the central frame 34 of the fitness-equipment storage bench 10. The stay 32 may also have a cross-bar 80 for strength. The inclusion of the channel 76 for the stay 32 in the side tray 70 is economical, and it reduces the number of components required to construct the fitness-equipment storage bench 10, simplifying customer assembly. The stay 32 may preferably be formed from 1.905 cm (¾ inch) mild steel tubing, with a 0.3175 cm (⅛ inch) wall thickness, and may have a galvanized finish.

It will be appreciated, however, that other designs of stay may be contemplated. For instance, the stay may comprise a single central support arm only, which may be fixed at the centre of the top of the fitness-equipment storage bench. The stay could be provided on a wheeled roller, which may run on an appropriate surface on the bottom face of the backrest. This design of the stay may simplify manufacture of the fitness-equipment storage bench.

The channel 76 preferably contains a plurality of stops 82, to allow the backrest 30 to be fixed in a plurality of different inclined positions. The stops 82 may be provided as obstructions in the channel, such as blocks or clips (small plates fixed in the channel). Alternatively, the stops could conceivably be provided as apertures in the base of the channel, which the legs of the stay would be receivable into at the desired backrest inclination angles. In either case, available backrest inclination angles may include 35 degrees, 45 degrees and 55 degrees from the horizontal. Additionally, to allow full access to a storage compartment 40 of the central frame, below the inclinable backrest 30, it would be advantageous for the backrest 30 to be inclinable at 90 degrees or greater from the horizontal. There may therefore be stops 82 associated with at least these inclinations, although other inclinations may be preferred, and the designer may select any number and location of stops 82 which allows an appropriate number of available inclinations without compromising usability. Furthermore, the stay 32 may be at least in part received within the channels when the backrest 30 is horizontal, so that the backrest 30 can lie at least in part flush with the top of the central frame 34, to provide a flat bench surface when desired.

Further fitness equipment storage may be provided by two end units 36,38, which may be attached to the central frame 34 to provide the ends 14,16 of the fitness-equipment storage bench 10. The central frame 34 and the two end units 36,38 may in combination give the fitness-equipment storage bench an overall H-shape or I-shape, depending on the relative dimensions of the central frame 34 and the two end units 36, 38.

The kettle ball cabinet, hereinafter referred to as the first end unit 36, may include a cuboidal or substantially cuboidal cabinet 84, with similar height to the central frame 34, and a longitudinal extent greater than the lateral extent of the central frame 34. The cabinet 84 typically may be formed from mild steel sheet metal, of 0.15875 cm thickness (1/16 inch). In a manner similar to other components hereinbefore mentioned, the metal may be finished by an undercoat and epoxy resin coating.

Preferably the cabinet 84 is closed at its end face 86, and has a base 88, to prevent the dislocation of stored fitness equipment when the fitness-equipment storage bench 10 is reoriented or relocated. However, the cabinet of the first end unit may alternatively be end-accessible via an open face, opposite to the face attachable to the central frame.

The first end unit 36 therefore may be particularly suitable for the storage of kettlebells 46, although, as with the side-accessible storage compartments 44 defined by central frame 34, storage of a wide variety of other fitness equipment may be appropriate, as long as said equipment can be safely rested on a flat surface. For ease of access, the cabinet 84 of the first end unit 36 may also be side-accessible via apertures 90 located on one or more side faces 92. The back face 94, which may be attachable to the central frame 34 via a plurality of screw-threaded apertures 96, preferably includes an aperture 98 to allow the storage of oversize exercise equipment across the first end unit 36 and the adjacent storage compartment 44 defined by the central frame 34.

The first end unit additionally may comprise one or more handles 100, which may be located at the top of the side faces 92 of the cabinet 84. The handles 100 may be used to lift and reorient the fitness-equipment storage bench 10. Furthermore, resistance training bands could also be attached to the handles 100 to perform resistance training exercises while standing adjacent to or seated on the bench. The handles 100 may have a galvanized finish.

The first end unit may preferably be reinforced with one or more other frames, hereinafter referred to as internal frame elements 102. The internal frame elements 102 may be located in the side faces 92 of the first end unit cabinet 84. In the preferred embodiment shown, the internal frame elements 102 each define two apertures 104, 106, the first aperture 104 corresponding to a side face aperture 90 of the first end unit cabinet 84, and the second aperture 106 corresponding to one of the handles 100.

Advantageously, the second aperture 106 of the internal frame element 102 may support an internal attachment member 108 of the handle 100, reducing the likelihood of failure of the handle 100 due to the repeated bearing of the load of the fitness-equipment storage bench 10 during repositioning.

The internal frame elements 102 may preferably be formed of 0.9525 cm (⅜ inch) by 1.27 cm (½ inch) rectangular hollow section (RHS) mild steel tubing, with wall thickness 0.15875 cm (1/16 inch).

At least part of the seat 28 of the fitness-equipment storage bench 10 may be supported by the top of the first end unit cabinet 84, preferably so that the seat 28 extends to the end of the fitness-equipment storage bench 10. The first end unit 36 may also comprise one or more adjustable feet 110, for support.

The medicine ball cabinet, hereinafter referred to as the second end unit 38, may also preferably comprise a cuboidal or substantially cuboidal cabinet 112, again with similar height to the central frame 34. Preferably the cabinet 112 of the second end unit 38 is end-accessible via a non-circular access opening 114 located on an end face 115 of the cabinet 112. The non-circular access opening 114 may have an elliptical, or substantially elliptical, cross-section, and may push-fit captively hold ball-shaped exercise equipment in the cabinet 112 of the second end unit 38. The second end unit thus may be suitable for the storage of one or more medicine balls or miniature Swiss balls. The major axes of the access opening 114 may preferably be at least 38.10 cm (15 inch) to accommodate standard 35.56 cm (14 inch) medicine balls.

There may additionally be provided a curved apron 116 at or adjacent to a lower edge 118 of the access opening 114, which may assist in storing or removing a ball 120 from the cabinet 112 of the second end-unit 38. Friction between the upper surface of the apron 116 and a ball 120 may assist in manual removal of the ball 120, by preventing the ball 120 rolling out with an unpredictable trajectory as soon as it leaves the aperture. A ball 120 can be returned to the cabinet 112 of the second end unit 38 by placing it on the apron 116, letting it fall back into the cabinet 112, directed by the curvature of the apron 116. To increase the friction between the upper surface of the apron 116 and a ball 120, beading, hereinafter referred to as a beaded covering 122, may be placed on a projecting free edge 124 of the apron 116. Preferably the beaded covering 122 may be formed from synthetic or natural rubber, and may be approximately 0.635 cm (¼ inch) thick for durability. The beaded covering could alternatively extend around the entire circumference of the access opening.

In the case where the access opening is rectangular or substantially rectangular, the apron may alternatively be located on a plurality of sides of the access opening, rather than or as well as at a lower edge of the access opening. While the apron is preferably provided as a one piece element, the apron could also conceivably be provided as a plurality of distinct elements, one being provided respectively for one or more sides of the rectangular or substantially rectangular access opening.

Optionally, the cabinet of the second end unit may also be side-accessible from one or more open side faces, to allow easy storage of other fitness accessories, with one or more balls.

The cabinet 112 of the second end unit 38 may be attachable to the central frame 34 via a plurality of threaded apertures 123 at a back face 125 opposite to the end face 115.

The back face 125 may also have a non-circular opening 126, to allow the storage of oversized non-spherical balls in the cabinet 112 of the second end unit 38, or the storage of other oversized fitness equipment in the adjacent side-accessible storage compartment 44 defined by the central frame 34.

The second end unit 38 may also include one or more internal frame elements 128, analogous to the internal frame elements 102 of the first end unit 36 hereinbefore described.

Furthermore, the second end unit 38 may comprise one or more adjustable feet 110, and one or more wheels 130 to allow reorientation or relocation of the fitness-equipment storage bench 10. The wheels 130 may be provided as casters, or integrally with the second end unit 38. At the top of the end face of the second end unit 38, above the access opening 114 if present, there may be provided a handle 132, which may be used to adjust the position of the bench. As per the handles 100 of the first end unit 36, resistance training bands could also be attached to the handle 132 to perform resistance training exercises while standing adjacent to or seated on the fitness-equipment storage bench 10. The top surface of the second end unit 38 may support at least part of the backrest; alternatively, the extent of the backrest 30 may be delimited by the central frame 36.

The first and second end units may also include other optional storage compartments such as a holder for a mobile phone or other personal computing device, and a holder for a cup and/or sports bottle. Any or all of the features of the first end unit herein described may also be incorporated into the second end unit, and vice versa.

FIG. 6*a*, shows the backrest 30 and seat 28. The backrest 30 may also be referred to as the back rest, the rest, the seat back, the seat cushion, or the top cushion. The seat 28 may be referred to as the rest, the seat back, and alternatively also as the seat cushion. For clarity, the backrest 30 and seat 28 are referred to as such alone hereinafter. The backrest 30 and seat 28 are preferably provided as multi-layered components, with similar structure, connected via a hinge 134, which forms the pivot between the backrest 30 and the seat 28, and allows the inclination of the backrest 30 with respect to the seat 28. The seat 28 may preferably be attached to the top of the central frame 34 and/or the first end unit 36, while the backrest 30 may only be connected to the seat 28 by the hinge 134, to allow free inclination. The hinge 134 most preferably is provided as a butt hinge to allow free inclination of the backrest 30 in any angle whereby it is not obstructed by other elements of the fitness-equipment storage bench 10.

The backing 136 of both the backrest 30 and the seat 28 may be formed from a vinyl polymer, such as a plasticized polyvinyl chloride (PVC), and also may include cover strips 138 to allow connection of the backrest 30 and/or seat 28 to the central frame 34 and/or one or more end units 36,38. The cover strips may preferably be formed from aluminium, and be approximately 0.3175 cm (⅛ inch) thick.

Above the backing 136 there may be a layer of plywood 140, to provide rigidity. High quality moisture-resistant plywood is desirable; a 1.905 cm (¾ inch) thick 5-layer plywood layer is preferred, but 7-layer marine plywood may also be appropriate; in this case BS 1088 compliant marine plywood is preferred. The main bodies 142*a,b* of the backrest 30 and seat 28 respectively, above the plywood layer, may include a foam layer 144, preferably comprising gymnasium quality high density foam; for instance, an ethylene-vinyl acetate (EVA) foam. The use of a close celled foam, such as a polyethylene (PE) foam, or a polyvinyl chloride/nitryl butadiene (PVC/NBR) foam ("gym rubber"). For aesthetic appeal, the backrest and seat may be covered with a vinyl polymer. Both the backrest and seat may also have edge elements 146, preferably formed from hardwood, to prevent or reduce damage at the edges of the backrest and seat, or by the hinge 134, during use, especially with respect to raising and lowering the backrest 30. The edge elements may preferably have elongate cuboidal dimensions, for instance with cross-section 1.905 cm (¾ inch) by 1.27 cm (½ inch).

The hinge 134 may preferably be fastened to the edge elements 146 of the backrest 30 and seat 28 respectively via a plurality screw-threaded fasteners, as shown in FIG. 6*b*. The stay 32 preferably may be attached to the backrest 30 via one or more hinges 148, as shown in FIG. 6*c*, to allow free rotation of the stay 32.

It is therefore possible to provide a fitness-equipment storage bench for use in aiding or supplementing a physical activity in a physical-activity environment whilst enabling storage of fitness equipment, the fitness-equipment storage bench comprising a cub oidal or substantially cuboidal body having first and second ends, two opposing sides between the first and second ends, a top and a bottom; at least one recess formed in one of the said sides; at least one cantilevered bar support in the recess for supporting a dumbbell such that a grip axis of the dumbbell is received entirely within the recess; at least one rotatable element at or adjacent to the first end or the second end to facilitate reorientation of the bench; a pivotable user back support on the top of the cuboidal body; and a stay associated with the back support to hold the back support in at least one raised condition.

This design of fitness-equipment storage bench advantageously allows the compact and accessible storage of a variety of fitness equipment, without affecting usability for resistance training or other physical activities.

The group exercise bench is equipped with a simple seat adjustment that allows the user to change the angle of adjustment easily by lifting a swing bar on the back of the seat cushion and place it in a block on the frame. The user may adjust the angle by lifting the seat cushion and moving the swing bar to a different position. There may be three designated angles. The bench may be transported by means of casters and a built in handle. The bench has storage options for accessories or equipment so that the user may store items to make it safer and more user friendly. The unwelded framework makes it possible to package and ship the product in a flat pack or knock down style, resulting in lower shipping and storage costs. The side storage racks may be interchangeable to allow the owner or user to sore other accessories or equipment in the bench.

The group exercise bench is used in an exercise or fitness training environment. It may be used alone or with several units in a class or group setting. It can be used as a portable exercise bench, a plyometric bench, a station to perform several different exercises that require support. The bench can store several fitness and exercise accessories and equipment. A user may attach items such as resistance tubing and other exercise equipment to the handles or attachment points. The bench may be placed in several different positions within the fitness area to make it most useful to the users and instructor or trainers providing the session or class. The user may lie on the bench in a flat position to perform exercises, or they may adjust the seat back with the adjustable swing arm. The user may change the location of the bench by simply lifting on the handle and rolling it on its casters to the desired location after or before use.

Concerning assembly of the invention, the framework would need to be assembled, with the provided bolts and nuts. Once the frame is assembled, one would attach the floor pan, and the top cushion with the swing bar for adjustment. Next one would attach the adjustable feet or cleats and then the backrest or seat cushion. Now one may level the bench by making adjustments of the screwing in or out of the adjustable feet.

The bench framework could be completely closed such that one cannot see through the bench.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

TABLE of correspondences
A table of correspondences for names and reference numerals between the priority U.S. Provisional Pat. application 62/325,370 and the present application is given below.

| The present application | U.S. 62/325,370 |
|---|---|
| Fitness-equipment storage bench 10 | Group exercise bench<br>Group exercise support bench<br>Group fitness exercise bench |
| Body 12 | (Shown on sheet 5 of the drawings) |
| First end 14 | (Shown on sheet 5 of the drawings) |
| Second end 16 | (Shown on sheet 5 of the drawings) |
| First side 18 | (Shown on sheet 5 of the drawings) |
| Second side 20 | (Shown on sheet 5 of the drawings) |
| Top 22 | (Shown on sheet 5 of the drawings) |
| Bottom 24 | (Shown on sheet 5 of the drawings) |
| Recesses 26 | (Shown on sheet 5 of the drawings) |
| Seat 28 | Rest<br>Seat back<br>Seat cushion |
| Backrest 30 | Back rest<br>Rest<br>Seat back<br>Seat cushion<br>Top cushion |
| Stay 32 | Backrest support bracket (26)<br>Swing bar (26) |
| Central frame 34 | Middle frame<br>Framework |
| First end unit 36 | Kettle bell cabinet (17) |
| Second end unit 38 | Medicine ball cabinet (16) |
| Storage compartments 40 | (Shown on sheet 5 of the drawings) |
| Base 42 | Floor<br>Floor pan<br>Shelving (.) |
| Side-accessible storage compartments 44 | (Shown on sheet 5 of the drawings) |
| Kettlebells 46 | Kettle bell |
| Base elements 48 | Shelving (.) |
| Dumbbells 50 | (Shown on sheet 5 of the drawings) |
| Bar supports 52 | (13) |
| Side frame unit 54 | Frame (1), (2) |
| Cross member 56 | (3) |
| Ledge 58 | (8) |
| Screw-threaded insert 60 | Threaded hole<br>Threaded insert (12) |
| Screw-threaded fasteners 62 | Fixing bolts |
| Side frame apertures 64 | (Shown on sheet 1 of the drawings) |
| Locating piece 66 | Locating piece |
| Further side frame apertures 68 | (Shown on sheet 1 of the drawings) |
| Side tray 70 | Side tray (15)<br>Tray |
| Fasteners 72 | Threaded rod (32)<br>Bolts |
| Elongate storage compartment 74 | (Shown on sheet 1 of the drawings) |
| Channel 76 | (Shown on sheet 1 of the drawings) |
| Stay legs 78 | (Shown on sheet 3 of the drawings) |
| Cross-bar 80 | (27) |
| Stops 82 | (Shown on sheet 1 of the drawings) |
| First end unit cabinet 84 | (Shown on sheet 4 of the drawings) |
| First end unit cabinet end face 86 | (17) |
| First end unit cabinet base 88 | (Shown on sheet 4 of the drawings) |
| First end unit cabinet side face aperture 90 | (Shown on sheet 4 of the drawings) |
| First end unit cabinet side face 92 | (Shown on sheet 4 of the drawings) |
| First end unit cabinet back face 94 | (Shown on sheet 4 of the drawings) |
| Screw-threaded apertures 96 | (Shown on sheet 4 of the drawings) |
| First end unit cabinet back face aperture 98 | (Shown on sheet 4 of the drawings) |
| First end unit handles 100 | Handle (24) |
| First end unit internal frame elements 102 | (6), (7) |
| Internal frame element first aperture 104 | (Shown on sheet 4 of the drawings) |
| Internal frame element second aperture 106 | (Shown on sheet 4 of the drawings) |
| Handle internal attachment member 108 | (Corresponds, for handle (24), to (29) indicated for handle (23), as shown on sheet 3 of the drawings) |
| Adjustable feet 110 | Adjustable feet (33) |

-continued

TABLE of correspondences
A table of correspondences for names and reference numerals between the priority U.S. Provisional Pat. application 62/325,370 and the present application is given below.

| The present application | U.S. 62/325,370 |
|---|---|
| Second end unit cabinet 112 | (Shown on sheet 3 of the drawings) |
| Access opening 114 | Opening |
| Second end unit cabinet end face 115 | Front |
| Apron 116 | Apron (34) |
| Access opening lower edge 118 | (Shown on sheet 3 of the drawings) |
| Ball 120 | (Shown on sheet 1 of the drawings) |
| Beaded covering 122 | Beading (35) |
| Screw-threaded apertures 123 | Hole and thread |
| Apron projecting free edge 124 | (Shown on sheet 3 of the drawings) |
| Second end unit cabinet back face 125 | Back |
| Second end unit cabinet back face opening 126 | (Shown on sheet 3 of the drawings) |
| Internal frame elements 128 | Internal frame (4), (5) |
| Wheel 130 | Casters 2 (31) |
| Second end unit handle 132 | Handle (23) |
| Hinge 134 | Hinge (28)<br>Butt hinge 2 (28) |
| Backing 136 | Backing |
| Cover strip 138 | Cover strip (22) |
| Layer of plywood 140 | Plywood (19) |
| Backrest main body 142a | (Shown on sheet 4 of the drawings) |
| Seat main body 142b | (Shown on sheet 4 of the drawings) |
| Foam layer 144 | Close cell foam (20)<br>Gymnasium quality high-density foam |
| Edge elements 146 | Hardwood edge |
| Hinge 148 | (25) |

The invention claimed is:

1. A fitness-equipment storage bench to aid or supplement a physical activity in a physical-activity environment whilst enabling storage of fitness equipment, the fitness-equipment storage bench comprising:

a cuboidal or substantially cuboidal body having first and second ends, two opposing sides between the first and second ends, a top and a bottom;

at least one recess formed in one of the said sides;

at least one cantilevered bar support in the recess to support a dumbbell such that a support axis is located entirely within the recess;

at least one rotatable element at or adjacent to the first end or the second end to facilitate reorientation of the bench;

a pivotable user back support on the top of the cuboidal body; and a stay associated with the back support to hold the back support in at least one raised condition;

wherein the body comprises a modular frame, wherein the modular frame comprises a plurality of side frame units, and a plurality of cross members which interconnect the side frame units, and wherein the body comprises two end units attached to the modular frame to provide the ends of the body.

2. The fitness-equipment storage bench as claimed in claim 1, further comprising at least one of: at least one recess formed in each of the said sides; a seat element which is at or adjacent to the back support and relative to which the back support is adapted to pivot; at least one handle at or adjacent to one or more of the said ends; and a plurality of side-accessible storage compartments.

3. The fitness-equipment storage bench as claimed in claim 1, further comprising at least one end recess in one of the said ends to house fitness equipment.

4. The fitness-equipment storage bench as claimed in claim 3, wherein the said end recess has a non-circular access opening to push-fit captively hold ball-shaped exercise equipment.

5. The fitness-equipment storage bench as claimed in claim 4, further comprising at least one of a curved apron and a beaded surface; the said curved apron being at or adjacent to a lower edge of the access opening to promote ingress and egress of said ball-shaped exercise equipment; and the said beaded surface being on a projecting free edge of the curved apron.

6. The fitness-equipment storage bench as claimed in claim 4, further comprising a second opening opposite to the access opening to allow storage of oversized ball-shaped exercise equipment in the end recess.

7. The fitness-equipment storage bench as claimed in claim 1, wherein the distance between the first and second ends defines or substantially defines a longitudinal extent of the fitness-equipment storage bench.

8. The fitness-equipment storage bench as claimed in claim 1, wherein a plurality of said cantilevered bar supports form a rack, which is integral with the said modular frame, to receive a plurality of dumbbells.

9. The fitness-equipment storage bench as claimed in claim 1, further comprising at least one side tray, located at least in part under the user back support.

10. The fitness-equipment storage bench as claimed in claim 9, wherein the said recess is defined by the modular frame and the said at least one side tray.

11. The fitness-equipment storage bench as claimed in claim 10, wherein the at least one side tray comprises a channel to receive the stay to support the back support in one or more raised conditions.

12. The fitness-equipment storage bench as claimed in claim 11, wherein the side tray further includes at least one storage compartment partitioned from the said channel.

13. The fitness-equipment storage bench as claimed in claim 11, further comprising at least one stop for the stay in the said at least one side tray.

14. The fitness-equipment storage bench as claimed in claim 11, comprising at least two side trays in which the stay can be received.

15. The fitness-equipment storage bench as claimed in claim 1, provided as a kit of parts.

16. The fitness-equipment storage bench as claimed in claim 15, provided in flat pack form.

17. A fitness-equipment storage bench to aid or supplement a physical activity in a physical-activity environment whilst enabling storage of fitness equipment, the fitness-equipment storage bench comprising:

a cuboidal or substantially cuboidal body having first and second ends, two opposing sides between the first and second ends, a top and a bottom;

at least one recess formed in one of the said sides;

at least one cantilevered bar support in the recess to support a dumbbell such that a support axis is located entirely within the recess;

at least one rotatable element at or adjacent to the first end or the second end to facilitate reorientation of the bench;

a pivotable user back support on the top of the cuboidal body; and a stay associated with the back support to hold the back support in at least one raised condition, further comprising at least one end recess in one of the said ends to house fitness equipment, wherein the said end recess has a non-circular access opening to push-fit captively hold ball-shaped exercise equipment, and further comprising at least one of a curved apron and a beaded surface; the said curved apron being at or adjacent to a lower edge of the access opening to promote ingress and egress of said ball-shaped exercise equipment; and the said beaded surface being on a projecting free edge of the curved apron.

* * * * *